US012338620B2

(12) United States Patent
Wilson et al.

(10) Patent No.: US 12,338,620 B2
(45) Date of Patent: Jun. 24, 2025

(54) TILT WALL COMPRISING A DUAL GASKET ASSEMBLY

(71) Applicants: DDP SPECIALTY ELECTRONC MATERIALS US, LLC, Wilmington, DE (US); DUPONT SAFETY & CONSTRUCTION, INC., Wilmington, DE (US)

(72) Inventors: Timothy D. Wilson, Wilmigton, DE (US); James Dean Katsaros, Wilmington, DE (US); Andrea Wagner Watts, Midland, MI (US); Jeffrey Hutchins, Buffalo, NY (US)

(73) Assignees: DDP SPECIALTY ELECTRONIC MATERIALS US, LLC, Wilmington, DE (US); DUPONT SAFETY & CONSTRUCTION, INC., Wilmington, DE (US)

( * ) Notice: Subject to any disclaimer, the term of this patent is extended or adjusted under 35 U.S.C. 154(b) by 246 days.

(21) Appl. No.: 18/307,234

(22) Filed: Apr. 26, 2023

(65) Prior Publication Data

US 2023/0358035 A1 Nov. 9, 2023

Related U.S. Application Data

(60) Provisional application No. 63/339,221, filed on May 6, 2022.

(51) Int. Cl.

| | |
|---|---|
| ***E04B 1/68*** | (2006.01) |
| *E04B 1/04* | (2006.01) |
| *E04B 1/61* | (2006.01) |

(52) U.S. Cl.

CPC ..... *E04B 1/6813* (2013.01); *E04B 1/04* (2013.01); *E04B 1/6158* (2013.01)

(58) Field of Classification Search

CPC ..... E04B 1/04; E04B 1/6158; E04B 1/6179; E04B 1/6813; E04B 1/68; E04B 2/822; E06B 3/3202

(Continued)

(56) References Cited

U.S. PATENT DOCUMENTS 3,603,055 A * 9/1971 Dale ..... E04B 1/6813 52/396.06
4,109,430 A * 8/1978 Fuller ..... E04B 2/822 52/592.6

(Continued)

FOREIGN PATENT DOCUMENTS

DE 2347007 A1 3/1975
GB 923776 A 4/1963

OTHER PUBLICATIONS

PCT International Search Report for Application No. PCT/US2023/018403; Melhem, Charbel, Authorized Officer; ISA/EPO; Jul. 6, 2023.

(Continued)

*Primary Examiner* — Paola Agudelo

(57) ABSTRACT

A tilt wall comprising a sealed abutment joint between two concrete wall panels comprising a first wall panel, a dual gasket assembly, and a second wall panel, wherein the dual gasket assembly comprises an interior gasket, a support coupling, and a weather gasket, with the support coupling attached to a first edge face of the first wall panel by the metallic channel, wherein the first and second wall panels are aligned adjacent to one another in the same plane, with the support coupling positioned between the first edge face of the first wall panel and a second edge face of the second wall panel, the second edge face of the second wall panel positioned relative to the first wall panel a desired distance proximate the first edge face to form a desired breadth of the abutment joint between the edge faces; and the interior (Continued)

gasket and the outer weather gasket in contact with and compressed against both the first and second edge faces to seal the abutment joint between the edge faces.

2 Claims, 5 Drawing Sheets

(58) Field of Classification Search
USPC ..... 52/716.2
See application file for complete search history.

(56) References Cited

U.S. PATENT DOCUMENTS 4,590,725 A * 5/1986 Kaminaga ..... E04B 2/90 52/843
5,678,372 A * 10/1997 Thomson ..... E04B 1/0007 52/287.1
11,885,118 B1 * 1/2024 Neiman ..... E04B 1/6179
2015/0276060 A1 * 10/2015 McGrath ..... F16J 15/027 277/645
2016/0123007 A1 * 5/2016 Daiber ..... E04C 2/044 52/583.1
2019/0078323 A1 * 3/2019 Strickland ..... E04B 1/6812
2020/0370685 A1 * 11/2020 Schlüsselbauer ..... F16L 47/00
2021/0025276 A1 * 1/2021 Dal Negro ..... B29C 66/30321
2021/0238844 A1 * 8/2021 Bräker ..... E04B 1/6812
2021/0333042 A1 * 10/2021 Gingras ..... E04B 1/6179

OTHER PUBLICATIONS

PCT International Search Report for Application No. PCT/US2023/018330; Melhem, Charbel, Authorized Officer; ISA/ EPO; Jul. 6, 2023.

* cited by examiner

TILT WALL COMPRISING A DUAL GASKET ASSEMBLY

BACKGROUND OF THE INVENTION

Field of the Invention

This invention relates to panel module useful in the construction of buildings, including commercial concrete tilt wall construction. The panel module comprises a panel provided with at least one dual gasket assembly suitable for sealing the abutment joint between panels and panel modules. As used herein, "panel" and "wall panel" are used interchangeably.

Description of Related Art

Tilt-wall construction is a building construction technique, normally using concrete for the walls, that typically requires less time to construct and is more cost-effective than many other building techniques. In a typical construction, large reinforced-concrete wall panels, that can span multiple floors, are first formed horizontally. Typically, a horizontal wooden frame is formed on the ground having the height and width of the desired wall, including openings for any windows, doors, or other desired openings in the wall. Reinforcement, such as a lattice of rebar, is inserted into the frame, followed by pouring concrete into the prepared frame and surfacing the top surface of the poured concrete as desired. After the concrete has cured, the horizontal wall panels are then lifted or "tilted" to a vertical position, generally with a crane, and then braced into position until the remaining building walls and structural elements (roofs, intermediate floors, etc.) are secured.

In buildings comprising multiple concrete wall panels, there is a challenge in sealing the vertical abutment joints between the panels. These sealed joints also need to meet design requirements and other desired performance expectations (e.g., thermal expansion and contraction; building sway and movement; water diversion; and thermal efficiency).

The gaps between the edge faces of individual wall panels, referred to as "abutment joints" or "panel-to-panel joints" interchangeably herein, have traditionally been sealed from the exterior of the building after the wall panels have been placed in position and stabilized, e.g., attached to the building support structure. In one traditional process, after the concrete panels are in a vertical position and stabilized, the gaps between the panels are sealed by first forcing a resilient support, known as a backer rod, into the gap from the outside of the building. This backer rod serves as a support for subsequently manually injecting a wet (liquid) sealant onto the exteriorly-oriented surface of the backer rod from the exterior of the building. Optionally, the interiorly-oriented surface of the backer rod can additionally be manually sealed in a similar manner with a wet (liquid) sealant from the interior of the building if a double seal is desired. The wet sealant fills at least a portion of the gap between the edges of the two abutting panels and provides an essentially permanently-fixed air and water seal, supported by the backer rod, once the sealant cures.

A high degree of workmanship, sometimes at considerable height and undesirable weather conditions, is needed to create an effective air and water seal. Long cure times for the wet sealant can also impact construction schedules.

Therefore, what is needed is a method suitable for making a tilt wall for commercial tilt wall construction, that comprises a sealed abutment joint between two wall panels having redundant sealing, that is made by a method that seals the panel-to-panel joints with less work on the exterior of the wall to seal these joints.

BRIEF SUMMARY OF THE INVENTION

This invention relates to a tilt wall comprising a sealed abutment joint between two concrete wall panels, the wall comprising a first wall panel, a dual gasket assembly, and a second wall panel, wherein the dual gasket assembly comprises an interior gasket, a support coupling, and a weather gasket, the first and second panels each having a height and a thickness, and each having a first major face and an opposing second major face, the first panel further having a first edge face, said first edge face being generally perpendicular to both the first major face and the opposing second major face of the first panel; the first edge face having a first edge face length that is the height of the first panel and a first edge face width that is the thickness of the first panel, the second panel further having a second edge face, said second edge face being generally perpendicular to both the first major face and opposing second major face of the second panel; the second edge face having a second edge face length that is the height of the second panel and a second edge face width that is the thickness of the second panel, wherein first panel has metallic channel anchor forming an integral metallic channel in the first edge face, the integral metallic channel anchor being oriented such that the metallic channel in the first edge face is parallel to the first edge face length; and wherein the support coupling for the dual gasket assembly is attached to the panel by the metallic channel, the support coupling comprising a base, the base having a top surface and a bottom surface, the top surface further having an interior gasket support and an exterior gasket support, the bottom surface of the base having a contact area for stabilizing the support coupling on the edge face, the bottom surface further having an attachment area for attaching the support coupling to said metallic channel, the attachment area being at least one projection;

wherein the first and second wall panels as aligned adjacent to one another, such that the first major face of the first wall panel and the first major face of the second wall panel lie in the same first plane, and the opposing second major face of the first wall panel and the opposing second major face of the second wall panel lie in the same second plane, and the first and second planes form a set of parallel major face planes, and the first edge face of the first wall panel and the second edge face of the second wall panel also form a set of parallel edge face planes, with the support coupling of the dual gasket assembly attached to the first edge face and positioned between the first edge face of the first wall panel and the second edge face of the second wall panel, within both the set of parallel major face planes and the set of parallel edge face planes, the second edge face of the second wall panel positioned relative to the first wall panel a desired distance proximate the first edge face to form a desired breadth of the abutment joint between the edge faces;

the interior gasket is attached to the interior gasket support and the outer weather gasket is attached to the exterior gasket support, the interior gasket and the outer weather gasket in contact with and compressed against both the first edge face of the first panel and the second edge face of the second panel to seal the abutment joint between the said edge faces of the two panels.

This invention also relates to a tilt wall panel comprising a first wall panel and a dual gasket assembly suitable for use in a wall having a sealed abutment joint between two concrete wall panels, wherein the dual gasket assembly comprises an interior gasket, a support coupling, and a weather gasket, the first wall panel each having a height and a thickness, and having a first major face and an opposing second major face, wherein the first major face of the first wall panel lies in a first plane, and the opposing second major face of the first wall panel lies in a second plane, and the first and second planes form a set of parallel major face planes, the first wall panel further having a first edge face, said first edge face being generally perpendicular to both the first major face and the opposing second major face of the panel; the first edge face having a first edge face length that is the height of the first wall panel and a first edge face width that is the thickness of the first wall panel, wherein the first wall panel has metallic channel anchor forming an integral metallic channel in the first edge face, the integral metallic channel anchor being oriented such that the metallic channel in the first edge face is parallel to the first edge face length; and wherein the support coupling for the dual gasket assembly is attached to the first wall panel by the metallic channel, the support coupling comprising a base, the base having a top surface and a bottom surface, the top surface further having an interior gasket support and an exterior gasket support, the bottom surface of the base having a contact area for stabilizing the support coupling on the first edge face, the bottom surface further having an attachment area for attaching the support coupling to said metallic channel, the attachment area being at least one projection;

with the support coupling of the dual gasket assembly attached to the first edge face within both the set of parallel major face planes, and the interior gasket is attached to the interior gasket support and the outer weather gasket is attached to the exterior gasket support.

DETAILED DESCRIPTION OF THE INVENTION

This invention relates to sealing features and methods for sealing abutment joints between panels, preferably panel-to-panel joints in commercial wall construction, and products that contain such sealing features, along with features for drainage of any water that may collect in any such joints. As used herein, the phrases "abutment joint" and "panel-to-panel joint" are interchangeable and mean a gap between the edge faces of two adjacent panels, especially in a wall system. The word panel is intended to include but is not limited to, a panel used as a building wall component. The panel is preferably made of concrete, preferably reinforced concrete. Further, unless otherwise indicated, there is no implied limitation on the orientation, design, or shape of the panels; while many building walls are generally vertically oriented and rectangular in shape, the inventions described herein can be applied to all panel-to-panel joints of any orientation or type useful in buildings. The inventions described herein can further relate to joint sealing features that are pre-installed on individual panels prior to the panels being incorporated into a wall.

Specifically, the inventions disclosed herein relate to dual gasket assemblies for sealing one or more abutment joints, and their use in panel modules and paneled wall systems, along with those panel modules and paneled walls and other components that are used in those walls, along with processes for making all of these inventions. In addition, the inventions disclosed herein include features specifically designed to manage and drain any water that may inadvertently collect in the dual gasket assemblies.

In some preferred embodiments, these inventions are made at a construction site and then used to build a wall of a building. Intuitively, the use of these inventions should reduce the time required to build and seal paneled walls at a construction site.

Figure 6:
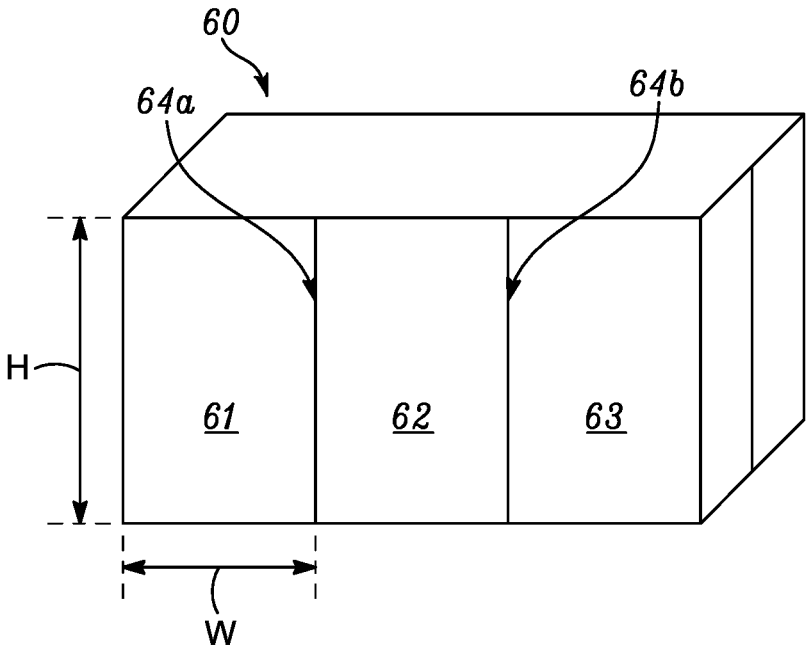
FIG. 6 is a perspective view of a building illustrating one example of a plurality of panels coupled together to form the building exterior illustrating a tilt wall formed from two panels and a sealed abutment joint between the panels.

FIG. 6 is a perspective view of a simple building 60 illustrating one type of wall assembly, the individual panels 61, 62, & 63, each having a height H and a width W as shown and being of sufficient size and arrangement such that the only panel-to-panel joints are vertically-oriented joints, for example, lines 64*a* and 64*b*. Many combinations are possible; the panels may span less than one story, one story, or more than one story of the structure. Wall assemblies comprising wall panels can represent an entire skin (or exterior facade) of a building, or just a portion thereof.

As used herein, a tilt wall comprises at a minimum a sealed abutment joint between two concrete wall panels, the wall comprising a first wall panel, a dual gasket assembly, and a second wall panel. The sealed abutment joint is created by the dual gasket assembly between the two wall panels, and the dual gasket assembly comprises an interior gasket, a support coupling, and a weather gasket. Therefore, as shown in FIG. 6, the combination of wall panels 61 and 62 with vertical joint 64*a* between the two panels sealed with the dual gasket assembly form a tilt wall.

Each of the first and second panels each having a height and a thickness, and each having a first major face and an opposing second major face. Additionally, the first panel further has a first edge face, said first edge face being generally perpendicular to both the first major face and the opposing second major face of the first panel; the first edge face having a first edge face length that is the height of the first panel and a first edge face width that is the thickness of the first panel. The second panel further has a second edge face, said second edge face being generally perpendicular to both the first major face and opposing second major face of the second panel; the second edge face having a second edge face length that is the height of the second panel and a second edge face width that is the thickness of the second panel.

The first panel is made with a metallic channel anchor that forms an integral metallic channel in the first edge face, the integral metallic channel anchor being oriented such that the metallic channel in the first edge face is parallel to the first edge face length. The support coupling for the dual gasket assembly is additionally attached to the panel by the metallic channel.

The support coupling comprises a base, the base having a top surface and a bottom surface. The top surface of the base of the support coupling further has an interior gasket support and an exterior gasket support. The bottom surface of the base of the support coupling has a contact area for stabilizing the support coupling on the edge face, and further has an attachment area for attaching the support coupling to the metallic channel, the attachment area being at least one projection extending from the base and seated in the metallic channel.

In the tilt wall, the first and second wall panels are aligned adjacent to one another, such that the first major face of the first wall panel and the first major face of the second wall panel lie in the same first plane, and the opposing second major face of the first wall panel and the opposing second major face of the second wall panel lie in the same second plane, and the first and second planes form a set of parallel major face planes. Additionally, the first edge face of the first wall panel and the second edge face of the second wall panel also form a set of parallel edge face planes. The support coupling of the dual gasket assembly is attached to the first edge face and positioned between the first edge face of the first wall panel and the second edge face of the second wall panel. The support coupling is also positioned within both the set of parallel major face planes and the set of parallel edge face planes.

Additionally, the second edge face of the second wall panel is positioned relative to the first wall panel a desired distance proximate the first edge face to form a desired breadth of the abutment joint between the edge faces. With this second wall panel in position, the abutment joint is sealed by the interior gasket and the outer weather gasket being in contact with and compressed against both the first edge face of the first panel and the second edge face of the second panel.

Figure 9:
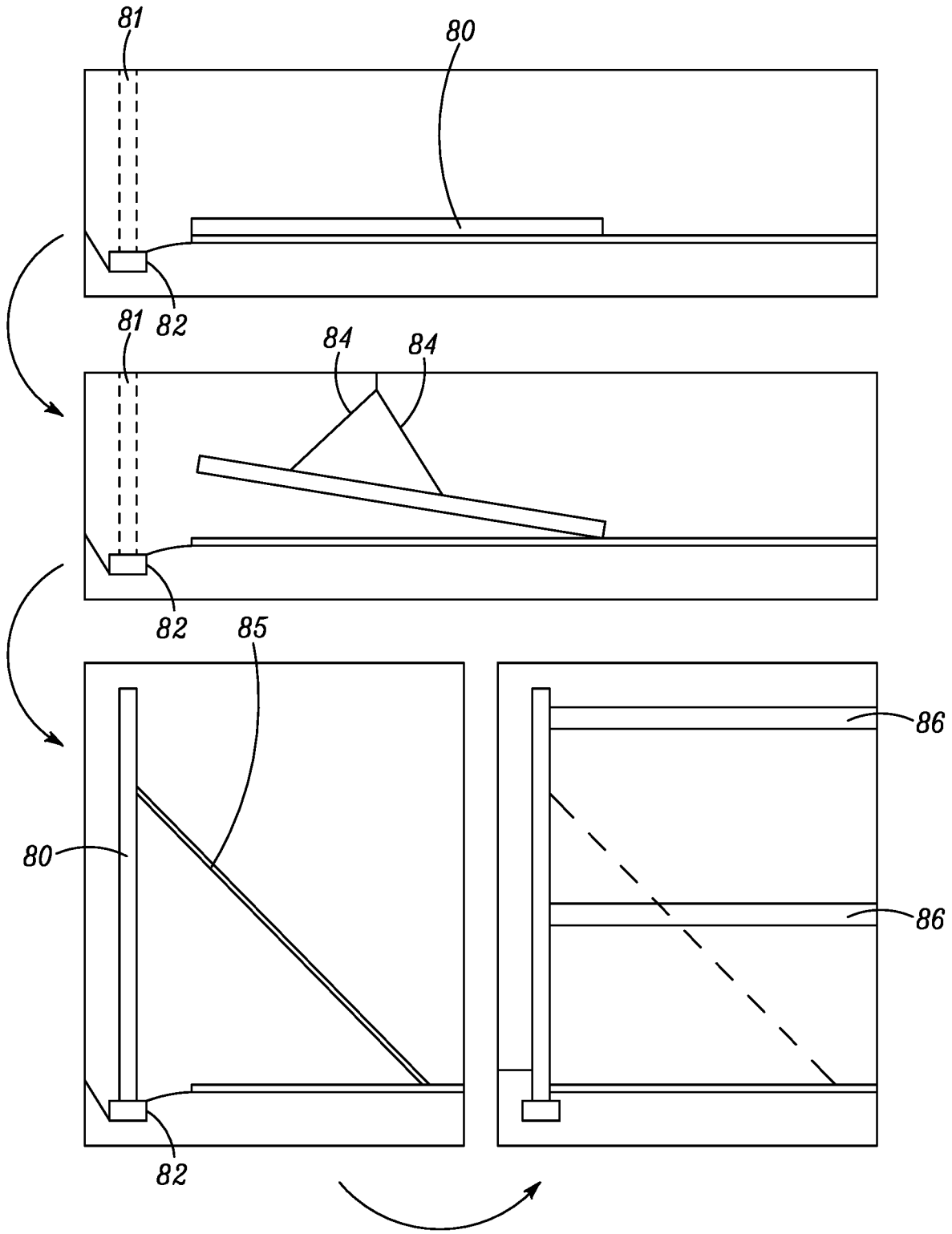
FIG. 9 illustrates a sequence of events illustrating the erection of a tilt-wall concrete wall panel.

FIG. 9 provides a traditional sequence of events illustrating the erection of a tilt-wall concrete wall panel module from a horizontal position to the desired vertical position. Initially, the wall panel 80 is made horizontally by casting concrete into a wooden cast form (not shown), the wooden cast form having desired features like window and door openings. Typically, as shown, the wall is cast close to the desired final vertical location for the wall panel; in the case of FIG. 9, this final vertical location is shown by the dotted lines 81, the wall to eventually be supported by footer 82. That wooden cast form is then removed after the concrete has cured.

After the wooden cast form is removed, the dual gasket assembly can be advantageously installed on the wall panel while the wall panel is still horizontal on ground level to form a wall panel module comprising the wall panel and the dual gasket assembly. The horizontal cured wall panel module is then lifted into position, typically by a crane using cables 84. Once the wall panel module is in place vertically, and seated on a footer, a temporary support 85 is typically installed to maintain the wall module in that position. Depending on the desired installation method for the wall system, additional wall panels or wall panel modules can be installed and temporarily supported in a similar manner. Permanent features of the building are installed, such as roof and floor supports 86, which allows the removal of the temporary support 85 (as shown by the dashed line). The result is a wall system wherein at least part of the sealing of the abutment joint is achieved by the compression of the two gaskets of the dual gasket assembly between the edge faces of two panels in the surface area to be sealed on each panel.

In some embodiments, this invention relates to a process for making a panel module suitable for use in a tilt wall, the panel module comprising a first panel having an integral metallic channel and a support coupling for a dual gasket assembly, the first panel having a height and a thickness, and having a first major face and an opposing second major face, the first panel further having a first edge face, the first edge face being generally perpendicular to both the first major face and the opposing second major face; the first edge face having a first edge face length that is the height of the first panel and a first edge face width that is the thickness of the first panel, The process comprises the steps of:

a) preparing a casting form for casting the first panel, the casting form comprising at least one casting form wall for forming the first edge face, wherein the at least one casting form wall includes a metallic channel anchor for forming the integral metallic channel in the first edge face, the integral metallic channel anchor being oriented such that the metallic channel in the first edge face is parallel to the first edge face length;
b) inserting structural reinforcing elements into the casting form and attaching the reinforcing elements to the metallic channel anchor;
c) applying concrete into the casting form and curing the concrete to form a first panel having an integral metallic channel anchored in the concrete;
d) removing the casting form; and
e) attaching to the metallic channel the support coupling for the dual gasket assembly, the support coupling comprising a base, the base having a top surface and a bottom surface, the top surface further having an interior gasket support and an exterior gasket support, the bottom surface of the base having a contact area for stabilizing the support coupling on the edge face, the bottom surface further having an attachment area for attaching the support coupling to said metallic channel, the attachment area being at least one projection.

Figure 1:
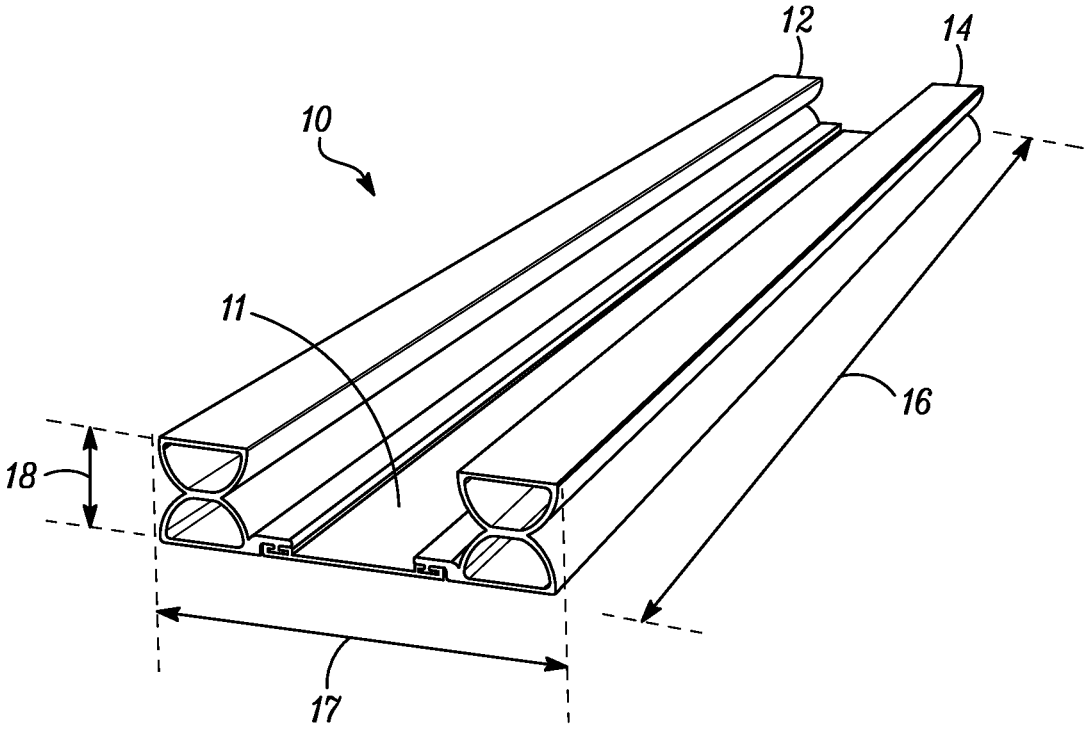
FIG. 1 is a perspective view of one example of a dual gasket assembly comprising a support coupling, a compressible interior gasket, and a compressible outer weather gasket.
Figure 2:
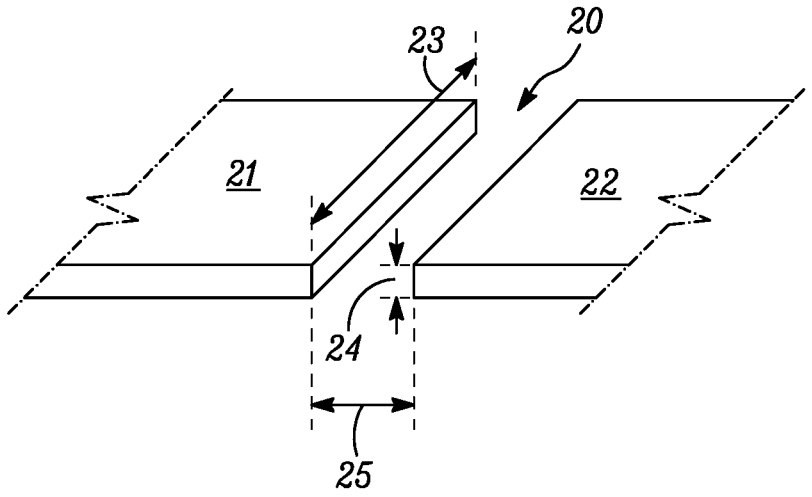
FIG. 2, is a perspective view of an abutment joint between the edge faces of two panels, the abutment joint having a length, width, and breadth.

The sealing of panel-to-panel joints utilizes a dual gasket assembly. FIG. 1 is a perspective view of one example of a dual gasket assembly 10 comprising a support coupling 11, a compressible interior gasket 12, and a compressible outer weather gasket 14, however, no projection from the support coupling for attachment to a wall panel edge face is shown. The dual gasket assembly is suitable for sealing an abutment joint 20 between the edge faces of two panels as shown in FIG. 2, wherein the abutment joint has a length, width, and breadth. For clarity of the illustration, FIG. 2 illustrates two panels that have been rotated 90 degrees from a vertical position to a general horizontal position, the two panels having two major faces 21 & 22 with abutment joint 20 (not drawn to scale) between the edge faces, the edge faces being perpendicular to the major faces of the panels. The length 23 of the abutment joint is the length of the larger edge face dimension that can be sealed as measured parallel to the plane of the panel. The width 24 of the abutment joint is the shorter edge face dimension that can be sealed as measured perpendicular to both the length 23 of the abutment joint and also perpendicular to the plane of the panel; the width of the abutment joint is essentially the thickness of a panel, assuming the abutment joint is between two panels of equal thickness. If the thicknesses of the two panels is different, then the width of the abutment joint is the thickness of the thinner panel. The breadth 25 of the abutment joint is the face-to-face distance between the two edge faces to be sealed. While not drawn to scale in FIG. 2 for clarity in defining the dimensions, the breadth 25 of the abutment joint (the gap between the edge faces when the panels are installed in a wall) can be and is typically much less than the width 24 of the abutment joint (which is typically the width of the panels). For example, the width 24 of the abutment joint could be 4 to 8 inches, while the breadth 25 of the abutment joint could be ½ to 1 inch.

Likewise, as shown in FIG. 1, the dual gasket assembly has a generally elongated rectangular footprint on the edge face of a wall panel and is configured to be attached to the edge face of a wall panel, and therefore has a length 16, width 17, and breadth 18 measured in a similar manner to the length 23, width 24, breadth 25 of the abutment joint. Specifically, the length 16 of the dual gasket assembly 10 is the overall centerline length of the long dimension of the dual gasket assembly. That length, along with the individual lengths of the components of the dual gasket assembly (support coupling 11, compressible interior gasket 12, and the compressible outer weather gasket 14) are all measured generally parallel to the length 23 of the abutment joint that will be sealed. The length 16 of the dual gasket assembly, or parts of the dual gasket assembly, can be longer, equal to, or shorter than the length 23 of the abutment joint. In particular, in some arrangements it can be desirable that the lengths of the compressible interior gasket 12 and the compressible outer weather gasket 14 be longer or shorter than the length 23 of any particular abutment joint, with the length of the support coupling 11 either being the same as or shorter than the length 23 of the abutment joint.

The width 17 of the dual gasket assembly is the next largest length dimension measured perpendicular to the length 16 of the dual gasket assembly. The width 17 of the dual gasket assembly is also the length that is parallel to the width 24 of the abutment joint. In some embodiments, the width 24 of the abutment joint is substantially more than the width 17 of the dual gasket assembly; in some embodiments, the width 17 of the dual gasket assembly is 50% or less than the width 24 of the abutment joint. In some embodiments, the width 17 of the dual gasket assembly is 25% or less than the width 24 of the abutment joint.

The breadth 18 of the dual gasket assembly is the thickness of the dual gasket assembly, not accounting for any projection that might extend from the support coupling base. The thickness of the dual gasket assembly as used herein is the distance between the outer contact faces of the gasket; that is, the outermost part of each gasket that will contact the edge faces of each panel that forms the abutment joint. The term "original breadth" of the dual gasket assembly, as used herein, is the breadth of the dual gasket assembly prior to any compressive force on the gaskets, in other words when the gaskets are in a relaxed state. The dual gasket assembly preferably has an original breadth 18 that is greater than the breadth 25 of the abutment joint between the two wall panels.

Figure 3:
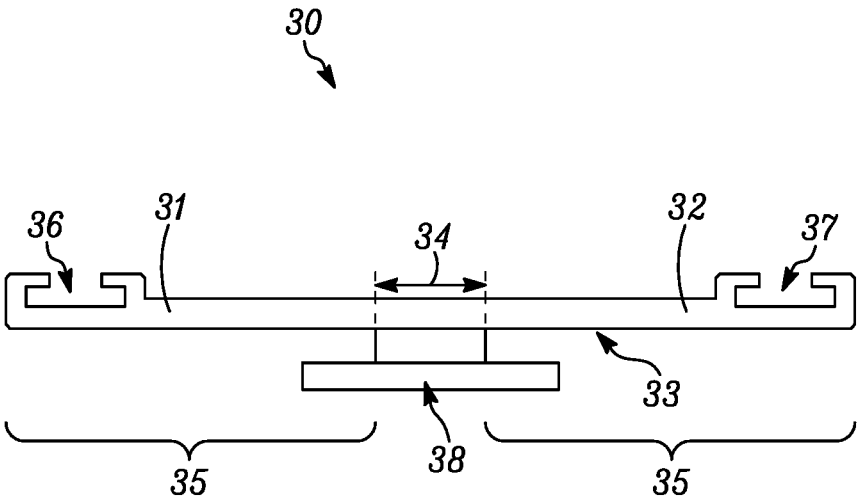
FIG. 3 is a cross-sectional view of one preferred embodiment of a support coupling for the dual gasket assembly.

FIG. 3 is a cross-sectional or end view of an embodiment of a support coupling for the dual gasket assembly. The support coupling 30 comprises an elongate body having a base 31, the base having a top surface 32 and a bottom surface 33. The top surface of the base further has an interior gasket support 36 and an exterior gasket support 37, and the interior gasket support and the exterior gasket support are on opposing sides of the top surface of the base of the support coupling. The compressible interior gasket is then attached to the interior gasket support and the compressible outer weather gasket is attached to the exterior gasket support (gaskets are not shown attached in FIG. 3). In the embodiment of FIG. 3, both the interior gasket support 36 and the exterior gasket support 37 have a c-shaped gasket retention cavity, a c-shaped channel parallel to and extending the length of the support coupling of the dual gasket assembly, designed to be used with the compressible interior gasket and a compressible outer weather gasket, wherein each gasket has a compatible T-shaped projection. In some embodiments, the support coupling has a length, parallel to the length of the dual gasket assembly, that corresponds to the length of the abutment joint between the edge faces of the two wall panels to be sealed.

The bottom surface 33 of the base 31 of the support coupling 30 has contact areas 35, on either side of T-shaped projection 38, the contact areas stabilizing the support coupling on an edge face of one of the two wall panels. This bottom surface further has an attachment area for attaching the support coupling to the edge face, the attachment area having at least one projection that can be seated in a metallic channel in the edge face of a panel to attach the support coupling to the panel. The support coupling of FIG. 3 has a base attachment area 34 that is considered the area on the bottom surface of the base, in the plane of the bottom surface on the base, that provides for the attachment of the support coupling to the edge face. The projection 38 shown in FIG. 3 has a "T" shape, designed to be slid or fitted into a C-shaped channel in the edge face of the panel.

Figure 4:
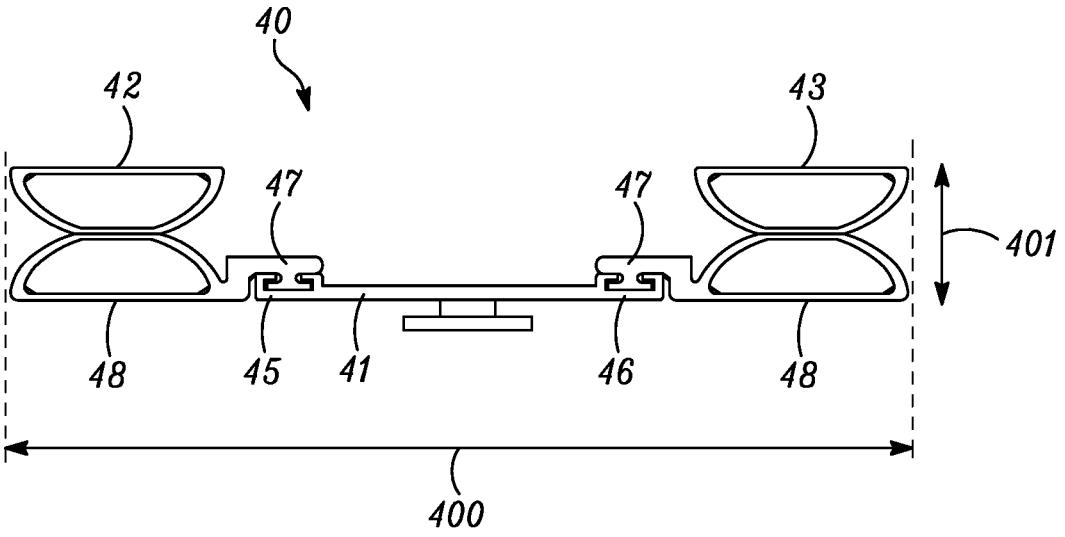
FIG. 4 is a cross-sectional view of a preferred dual gasket assembly comprising a support coupling, a compressible interior gasket, and a compressible outer weather gasket.

FIG. 4 is a cross-sectional view of a preferred dual gasket assembly 40 comprising a support coupling 41, a compressible interior gasket 42, and a compressible outer weather gasket 43. In this embodiment, the compressible interior gasket 42 and a compressible outer weather gasket 43 have a hollow, flattened, hour-glass shape, the flattened or straight sides of the hour-glass (the contact faces) configured to match with the planar edge face of the panels to be sealed. The compressible interior gasket and the compressible outer weather gasket are attached to the support coupling via gasket supports (45 & 46) on opposing ends of the support coupling.

Attaching the compressible interior gasket and the compressible outer weather gasket on opposing sides of the support coupling provides the advantages of a redundant gasketing system; the compressible outer weather gasket generally facing the outside environment of the wall while the compressible interior gasket generally faces the inside environment of the wall.

In the embodiment shown in FIG. 4, both the interior gasket support 45 and the exterior gasket support 46 have a c-shaped gasket retention cavity, and the compressible interior gasket 42 and a compressible outer weather gasket 43 each have a compatible T-shaped projection 47 that is seated in each c-shaped cavity.

FIG. 4 further illustrates the width and breadth dimensions of the dual gasket assembly, both of which can be measured perpendicular to the length of the dual gasket assembly. The width of the dual gasket assembly is the dimension 400 in FIG. 4, that is the dimension that will be parallel to the width dimension of the abutment joint that is to be sealed; the compressible interior gasket 42, the support coupling 41, and the compressible outer weather gasket 43 all contribute to the width of the dual gasket assembly. That is, the width of the dual gasket assembly is the distance from an outer periphery of the compressible interior gasket to an outer periphery of the compressible outer weather gasket as shown. The original breadth of the dual gasket assembly is also shown in FIG. 4, i.e., the dual gasket assembly wherein the gaskets are in an uncompressed state. In some embodiments, the dual gasket assembly has a width as measured perpendicular to both the length and breadth of the dual gasket assembly; the width being measured from the maximum outer periphery of the compressible interior gasket to the maximum outer periphery of the compressible outer weather gasket, which is generally less than the width of the abutment joint between the two wall panels.

The original breadth of the dual gasket assembly is the thickness of the dual gasket assembly prior to any compression of the gaskets in the sealing of an abutment joint, that is when the gaskets are in a relaxed state. The original breadth is the distance between the outermost part of each gasket that will contact the edge faces of the panel is shown by the dimension 401 in FIG. 4. In that figure, the flat edge faces shown on the compressible interior gasket and the flat edge faces shown on the compressible outer weather gasket are the outermost part from which the original breadth is measured. For the purposes herein, the breadth of the dual gasket assembly is measured excluding any projections extending from the base; only the gasket measurements are considered. Further, while gaskets having flat faces are illustrated in the figures, other shapes are possible, and in that instance the original breadth of the dual gasket assembly is the maximum thickness of the uncompressed gasket as measured perpendicular to the base of the support coupling.

To form a seal, the dual gasket assembly has an original breadth that is more than the breadth of the abutment joint between the two panels to be sealed. Once the dual gasket assembly has sealed an abutment joint between the two panels, the installed breadth of the dual gasket assembly is preferably the same as the breadth of the abutment joint between the two panels.

The interior gasket support (36,45) and exterior gasket support (37,46) are preferably made integral with the support coupling base. If desired, each of the gasket support can further be made integral with its associated gasket. However, in some embodiments it can be desirable to make only the compressible interior gasket integral with a gasket support and allow the compressible outer weather gasket to remain removable from the support, so that it can be replaced if necessary due to weathering.

In the embodiments of the support coupling and dual gasket assembly shown in FIGS. 3 & 4, each interior gasket support (36,45) and exterior gasket support (37,46) has a gasket retention cavity for attaching the compressible interior gasket 42 and compressible outer weather gasket 43, respectively, via a gasket retention projection 47 extending from each of the respective gaskets. However, either or both of the gasket supports in the set could have a gasket retention projection for attaching its respective gasket, with the respective gasket(s) having a matching cavity for seating the associated gasket retention projection.

Specifically, in some embodiments, the compressible interior gasket of the dual gasket assembly is attached to the interior gasket support by either i) a projection extending from the interior gasket support seated in a cavity in the compressible interior gasket, or ii) a projection extending from the compressible interior gasket seated in a cavity in the interior gasket support.

In some embodiments, the compressible outer weather gasket of the dual gasket assembly is attached to the exterior gasket support by i) a projection extending from the exterior gasket support seated in a cavity in the compressible outer weather gasket, or ii) a projection extending from the compressible outer weather gasket seated in a cavity in the exterior gasket support.

In some preferred embodiments, the interior gasket support and the exterior gasket support each has at least one projection or cavity for the attachment of a gasket. As used herein, a "projection" extending from a part means the part has an appendage extending (or jutting out) from the part that has a suitable size and shape that it can be inserted into a suitably-sized and shaped cavity in a second part and seated in that cavity to connect or attach the two parts together. In some embodiments the projection is known as a "dart" and can have any shape typically used for such dart as conventionally known, such as, an arrow shape, a tree shape, a barbed shape, or a "T" shape. The associate cavity with each of these shapes is an opening in the part that allows the shape to be entered and seated in that part.

By "seat" or "seated" it is meant the projection is mechanically retained or held in the cavity to secure the projection in the cavity and connect or attach the two parts together. By cavity, it is meant a pocket, channel, unfilled space, or hollowed-out space into the surface of a part that has a suitable size and shape that can accept and seat a suitably-sized and shaped projection.

When projections and cavities are used, they must adequately attach each gasket and gasket support together such that the dual gasket assembly can further be attached to an edge face of a panel and the gaskets remain attached if the panel is moved; and further, the gaskets can be compressed between two adjacent edge faces without either gasket detaching from its gasket support. Alternatively, the support coupling can first be attached to an edge face of a panel, followed by the attachment of each gasket with any combination of projections and cavities, which again must adequately attach each gasket and gasket support such that the gaskets remain attached if the panel is moved; and further, the gaskets can be compressed between two adjacent edge faces without either gasket detaching from its gasket support.

Many different arrangements of projections and cavities are contemplated. For example, a linear-arranged set of individually-separated gasket darts and a compatible linear-arranged set of individually-separated gasket support cavities, both linear arrangements oriented parallel to the length of the dual gasket assembly when installed and extending essentially the length of the support coupling could be used, with the number of attachment points dictated by the gasketing application. In a preferred embodiment, the projection is a continuous projection, meaning that it extends essentially the length of the support coupling oriented parallel to the length of the dual gasket assembly when installed. Likewise, a preferred embodiment, the cavity is a continuous channel, again meaning that it extends essentially the length of the support coupling oriented parallel to the length of the dual gasket assembly when installed.

In some preferred embodiments, the projection can have a cross-sectional "T" shape, that can in turn be seated in a cavity having a cross-sectional "C" shape as shown by the cross-sectional views of the support coupling and dual gasket assembly of FIGS. 3 & 4. The C-shaped cavity typically forms a channel on or in the support coupling base, the channel oriented parallel to the length of the dual gasket assembly and extending in a preferably continuous manner along the length of the support coupling base. Likewise, the associated gasket will have a T-shaped projection extending in a preferably continuous manner along the length of the gasket.

Figure 8:
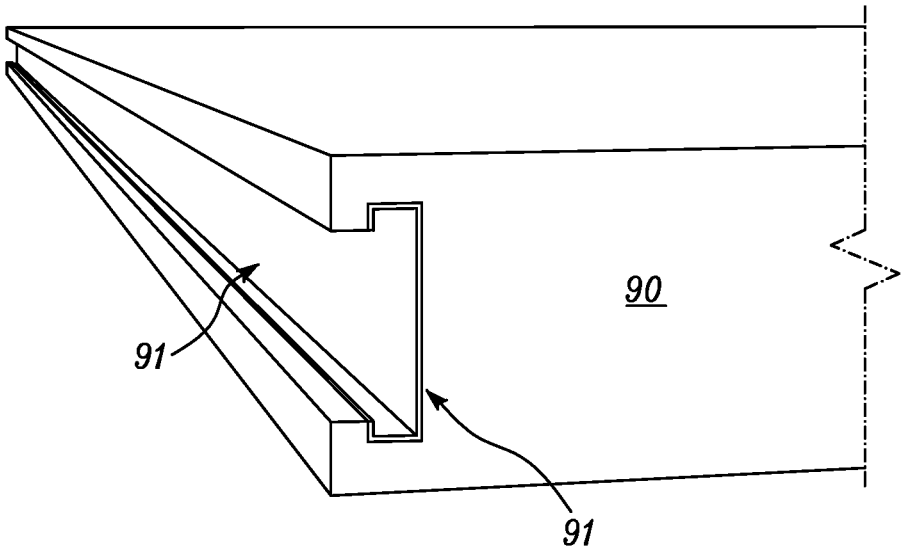
FIG. 8 is a perspective view of a panel having one possible type of C-channel formed in an edge face using a metallic C-shaped channel anchor.

Likewise, a T-shaped projection extending in a preferably continuous manner along the length of the base of the support coupling is seated in a C-shaped cavity, typically forms a channel on or in the edge face of a wall panel with the channel oriented parallel to the length of the edge face length and extending in a preferably continuous manner along that edge face length. FIG. 8 illustrates a panel 90 having one possible type of C-channel 91 formed in the edge face using a metallic C-shaped channel anchor 91.

In some preferred embodiments, the compressible interior gasket and compressible outer weather gasket have the same shape, and one preferred shape is shown in FIG. 4 as a dual-lobed, hollow, flattened, hour-glass shape, the flattened or straight sides of the hour-glass configured to match with the planar edge face of the panels to be sealed. However, there is no requirement the shape of the compressible interior gasket and a compressible outer weather gasket be the same. Other gasket shapes and materials are believed suitable for use in the application. It is believed that many different gasketing materials, having a round or mostly round, curved, or rectangular or mostly rectangular cross section, or combinations thereof, could be used as gaskets in the dual gasket assembly.

In preferred embodiments, the shape of the gaskets and gasket supports are configured such that both the compressible interior gasket and the compressible outer weather gasket are not compressed onto the edge face of a wall panel when the dual gasket assembly is attached to that edge face. As shown in FIG. 4, the bottom contact surface 48 of each gasket aligns with the bottom surface of the base of the support coupling. This facilitates the installation of the dual gasket assembly on the edge face of a wall panel.

For example, for the preferred embodiment shown in FIG. 4, to install the dual gasket assembly on the edge face of a wall panel, the support coupling can be first attached to the edge face, and then the T-shaped projection of the compressible interior gasket can be slid into the C-shaped interior gasket support of the support coupling to attach the compressible interior gasket. The compressible outer weather gasket can be attached in like matter to the exterior gasket support. Since the base surface of the gaskets is at most flush with the bottom surface of the support coupling, the gaskets can be slid into the C-shaped cavities in the support coupling without substantial friction from the edge face of the wall.

Alternatively, both the compressible interior gasket and the compressible outer weather gasket can be attached to the support coupling, again by sliding each T-shaped gasket projection into its associated C-shaped gasket support on the support coupling to make a fully-assembled dual gasket assembly, and then the support coupling can be attached to the edge face of the wall panel. Again, since the base surface of the gaskets is at most flush with the bottom surface of the support coupling, the dual gasket assembly can be attached without first compressing the gaskets on the edge face of the wall. Both of these techniques allow easier and more precise placement of the dual gasket assembly on the edge face of the wall. Further, this preferred gasket configuration still provides adequate sealing of the abutment joint, as both the compressible interior gasket and the compressible outer weather gasket are later compressed against both edge faces of the abutment joint by contact with a second edge face from another wall to fully seal the abutment joint.

Preferably in the use of the dual gasket assembly in a tilt wall, the compressible interior gasket is installed on the support coupling as a condensed interior gasket and the compressible outer weather gasket is also installed on the support coupling as a condensed outer weather gasket. By "condensed" it is meant the original breadth of the gasket is reduced such that the gasket breadth is less than the abutment joint to be sealed. In some embodiments the breadth of each of the condensed interior gasket and the condensed outer weather gasket can be as much as 50% or more of the breadth of the abutment joint.

The condensed interior gasket and the condensed outer weather gasket are believed to be particularly useful with tilt wall construction, as concrete tilt wall panels are rather large and heavy, and they could potentially damage the gaskets installed on the edge faces of the wall panels during the lifting and vertical positioning of the wall panels.

Therefore, by casting the concrete wall panel with an integral metallic channel anchored in the concrete, the edge face has a metallic channel by which the support coupling can be attached by sliding the projection from the support coupling base into the channel at any desired point during the installation of the wall panels. For example, the support coupling can be attached to the channel while the wall panel is in a horizontal position prior to being lifted into a vertical position, or the support coupling can be attached to the channel after the wall panel has been lifted into a vertical position. In one preferred embodiment, the support coupling is attached to the channel after two adjacent panels have been lifted and positioned vertically in place, with the metallic channel positioned in the edge face making up one side of the abutment joint between the panels. The support coupling can be slid down between the two edge faces of the panel, with the projection from the base of the support coupling inserted in the channel to attach the support coupling to one of the edge faces.

The use of the condensed interior gasket and the condensed outer weather gasket allows the gaskets to similarly be installed as desired. For example, the two condensed gaskets can likewise be installed, by inserting a gasket projection into a C-shaped gasket support channel and sliding the condensed gasket onto the support coupling. The installation of the condensed gaskets can be done prior to the installation of the support coupling on the wall, and the whole dual gasket assembly installed as previously described for the installation of just the support coupling while the wall panel is in a horizontal or vertical position, or preferably when two concrete wall panels are already vertically in place with a desired abutment joint.

That is, in the process for making a panel module, prior to attaching to the metallic channel the support coupling for the dual gasket assembly, a condensed interior gasket is attached to the interior gasket support of the support coupling, and a condensed outer weather gasket is attached to the exterior gasket support of the support coupling. Additionally, after the condensed gaskets are attached, the process can include a step of expanding the condensed interior gasket and the condensed outer weather gasket or allowing the condensed interior gasket and the condensed outer weather gasket to expand.

Alternatively, the condensed gaskets can be installed after the support coupling has been installed on the edge face of the wall panel. That is, in the process for making a panel module, after attaching to the metallic channel the support coupling for the dual gasket assembly, a condensed interior gasket is attached to the interior gasket support of the support coupling, and a condensed outer weather gasket is attached to the exterior gasket support of the support coupling. Additionally, after the condensed gaskets are attached, the process can include a step of expanding the condensed interior gasket and the condensed outer weather gasket or allowing the condensed interior gasket and the condensed outer weather gasket to expand.

Therefore, in one embodiment, this invention relates to a process for making a tilt wall having a sealed abutment joint, the wall comprising a first wall panel, a dual gasket assembly, and a second wall panel, wherein the dual gasket assembly comprises an interior gasket, a support coupling, and a weather gasket, the first and second panels each having a height and a thickness, and each having a first major face and an opposing second major face, the first panel further having a first edge face, said first edge face being generally perpendicular to both the first major face and the opposing second major face of the first panel; the first edge face having a first edge face length that is the height of the first panel and a first edge face width that is the thickness of the first panel, the second panel further having a second edge face, said second edge face being generally perpendicular to both the first major face and opposing second major face of the second panel; the second edge face having a second edge face length that is the height of the second panel and a second edge face width that is the thickness of the second panel, the process including the steps of:

a) preparing a horizontally-oriented casting form for casting the first panel, the casting form comprising at least one casting form wall for forming the first edge face, wherein the at least one casting form wall includes a metallic channel anchor for forming the integral metallic channel in the first edge face, the integral metallic channel anchor being oriented such that the metallic channel in the first edge face is parallel to the first edge face length;

b) inserting structural reinforcing elements into the casting form and attaching the reinforcing elements to the metallic channel anchor;

c) applying concrete into the casting form and curing the concrete to form a horizontally-oriented first panel having an integral metallic channel anchored in the concrete;

d) removing the casting form; and e) attaching to the metallic channel the support coupling for the dual gasket assembly, the support coupling comprising a base, the base having a top surface and a bottom surface, the top surface further having an interior gasket support and an exterior gasket support, the bottom surface of the base having a contact area for stabilizing the support coupling on the edge face, the bottom surface further having an attachment area for attaching the support coupling to said metallic channel, the attachment area being at least one projection;

with the proviso that either before or after the attachment of the support coupling to the metallic channel, a condensed interior gasket is attached to the interior gasket support of the support coupling, and a condensed outer weather gasket is attached to the exterior gasket support of the support coupling;

f) moving the horizontally-oriented first panel from a horizontal to a vertical position, with the first edge face length with attached support coupling for the dual gasket assembly also oriented vertically;

g) providing a second panel in a vertical position, with the second edge face length also oriented vertically;

h) aligning the first and second wall panels, such that the first major face of the first wall panel and the first major face of the second wall panel lie in the same first plane, and the opposing second major face of the first wall panel and the opposing second major face of the second wall panel lie in the same second plane, and the first and second planes form a set of parallel major face planes, and the first edge face of the first wall panel and the second edge face of the second wall panel also form a set of parallel edge face planes, with the support coupling of the dual gasket assembly attached to the first edge face positioned between the first edge face of the first wall panel and the second edge face of the second wall panel within both the set of parallel major face planes and the set of parallel edge face planes, and moving the second wall panel relative to the first wall panel to move the second edge face to a desired distance proximate the first edge face to form a desired breadth of the abutment joint between the edge faces; and i) expanding the condensed interior gasket and the condensed outer weather gasket or allowing the condensed interior gasket and the condensed outer weather gasket to expand and contact and compress against both the first edge face of the first panel and the second edge face of the second panel, to seal the abutment joint between the said edge faces of the two panels.

Alternatively, the support coupling can be attached to the edge face prior to lifting the panel into a vertical position, followed by inserting the condensed gaskets after two adjacent panels have been lifted and positioned vertically in place, with the metallic channel positioned in the edge face making up one side of the abutment joint between the panels and having the support coupling attached.

That embodiment relates to a process for making a tilt wall having a sealed abutment joint, the wall comprising a first wall panel, a dual gasket assembly, and a second wall panel, wherein the dual gasket assembly comprises an interior gasket, a support coupling, and a weather gasket, the first and second panels each having a height and a thickness, and each having a first major face and an opposing second major face, the first panel further having a first edge face, said first edge face being generally perpendicular to both the first major face and the opposing second major face of the first panel; the first edge face having a first edge face length that is the height of the first panel and a first edge face width that is the thickness of the first panel, the second panel further having a second edge face, said second edge face being generally perpendicular to both the first major face and opposing second major face of the second panel; the second edge face having a second edge face length that is the height of the second panel and a second edge face width that is the thickness of the second panel, the process including the steps of:

a) preparing a horizontally-oriented casting form for casting the first panel, the casting form comprising at least one casting form wall for forming the first edge face, wherein the at least one casting form wall includes a metallic channel anchor for forming the integral metallic channel in the first edge face, the integral metallic channel anchor being oriented such that the metallic channel in the first edge face is parallel to the first edge face length;

b) inserting structural reinforcing elements into the casting form and attaching the reinforcing elements to the metallic channel anchor;

c) applying concrete into the casting form and curing the concrete to form a horizontally-oriented first panel having an integral metallic channel anchored in the concrete;

d) removing the casting form; and e) attaching to the metallic channel the support coupling for the dual gasket assembly, the support coupling comprising a base, the base having a top surface and a bottom surface, the top surface further having an interior gasket support and an exterior gasket support, the bottom surface of the base having a contact area for stabilizing the support coupling on the edge face, the bottom surface further having an attachment area for attaching the support coupling to said metallic channel, the attachment area being at least one projection;

f) moving the horizontally-oriented first panel from a horizontal to a vertical position, with the first edge face length with attached support coupling for the dual gasket assembly also oriented vertically;

g) providing a second panel in a vertical position, with the second edge face length also oriented vertically; and h) aligning the first and second wall panels, such that the first major face of the first wall panel and the first major face of the second wall panel lie in the same first plane, and the opposing second major face of the first wall panel and the opposing second major face of the second wall panel lie in the same second plane, and the first and second planes form a set of parallel major face planes, and the first edge face of the first wall panel and the second edge face of the second wall panel also form a set of parallel edge face planes, with the support coupling of the dual gasket assembly attached to the first edge face positioned between the first edge face of the first wall panel and the second edge face of the second wall panel within both the set of parallel major face planes and the set of parallel edge face planes, and moving the second wall panel relative to the first wall panel to move the second edge face to a desired distance proximate the first edge face to form a desired breadth of the abutment joint between the edge faces;

i) attaching a condensed interior gasket to the interior gasket support of the support coupling and attaching a condensed outer weather gasket to the exterior gasket support of the support coupling; and j) expanding, or allowing the expansion of, the condensed interior gasket and the condensed outer weather gasket, to contact and compress against both the first edge face of the first panel and the second edge face of the second panel to seal the abutment joint between the said edge faces of the two panels.

In one preferred embodiment, the support coupling is attached to the channel of an edge face after two adjacent panels have been lifted and positioned vertically in place, with the metallic channel positioned in the edge face making up one side of the abutment joint between the panels. The support coupling is then slid down between the two edge faces of the panel, with the projection from the base of the support coupling inserted in the channel to attach the support coupling to one of the edge faces. Each of the condensed interior gasket and the condensed outer weather gasket are then slid down between the two edge faces of the panel to form the dual gasket assembly between the edge faces of the two wall panels.

That embodiment relates to a process for making a tilt wall having a sealed abutment joint, the wall comprising a first wall panel, a dual gasket assembly, and a second wall panel, wherein the dual gasket assembly comprises an interior gasket, a support coupling, and a weather gasket, the first and second panels each having a height and a thickness, and each having a first major face and an opposing second major face, the first panel further having a first edge face, said first edge face being generally perpendicular to both the first major face and the opposing second major face of the first panel; the first edge face having a first edge face length that is the height of the first panel and a first edge face width that is the thickness of the first panel, the second panel further having a second edge face, said second edge face being generally perpendicular to both the first major face and opposing second major face of the second panel; the second edge face having a second edge face length that is the height of the second panel and a second edge face width that is the thickness of the second panel, the process including the steps of:

a) preparing a horizontally-oriented casting form for casting the first panel, the casting form comprising at least one casting form wall for forming the first edge face, wherein the at least one casting form wall includes a metallic channel anchor for forming the integral metallic channel in the first edge face, the integral metallic channel anchor being oriented such that the metallic channel in the first edge face is parallel to the first edge face length;

b) inserting structural reinforcing elements into the casting form and attaching the reinforcing elements to the metallic channel anchor;

c) applying concrete into the casting form and curing the concrete to form a horizontally-oriented first panel having an integral metallic channel anchored in the concrete;

d) removing the casting form; and e) moving the horizontally-oriented first panel from a horizontal to a vertical position, with the first edge face length with attached support coupling for the dual gasket assembly also oriented vertically;

f) providing a second panel in a vertical position, with the second edge face length also oriented vertically; and g) aligning the first and second wall panels, such that the first major face of the first wall panel and the first major face of the second wall panel lie in the same first plane, and the opposing second major face of the first wall panel and the opposing second major face of the second wall panel lie in the same second plane, and the first and second planes form a set of parallel major face planes, and the first edge face of the first wall panel and the second edge face of the second wall panel also form a set of parallel edge face planes, with the support coupling of the dual gasket assembly attached to the first edge face positioned between the first edge face of the first wall panel and the second edge face of the second wall panel within both the set of parallel major face planes and the set of parallel edge face planes, and moving the second wall panel relative to the first wall panel to move the second edge face to a desired distance proximate the first edge face to form a desired breadth of the abutment joint between the edge faces;

h) attaching to the metallic channel the support coupling for the dual gasket assembly, the support coupling comprising a base, the base having a top surface and a bottom surface, the top surface further having an interior gasket support and an exterior gasket support, the bottom surface of the base having a contact area for stabilizing the support coupling on the edge face, the bottom surface further having an attachment area for attaching the support coupling to said metallic channel, the attachment area being at least one projection;

with the proviso that either before or after the attachment of the support coupling to the metallic channel, a condensed interior gasket is attached to the interior gasket support of the support coupling, and a condensed outer weather gasket is attached to the exterior gasket support of the support coupling;

i) expanding, or allowing the expansion of, the condensed interior gasket and the condensed outer weather gasket, to contact and compress against both the first edge face of the first panel and the second edge face of the second panel to seal the abutment joint between the said edge faces of the two panels.

As previously described, the condensed gaskets have a reduced breadth, which is less than the breadth of the abutment gap, that allows them to be inserted after the abutment gap has been formed, and in some embodiments the breadth of each of the condensed interior gasket and the condensed outer weather gasket can be as much as 50% or more of the breadth of the abutment joint. However, the condensed gaskets should also expand and be further compressible such that they can compress against both edge faces of the abutment joint once the condensed gaskets are positioned in place, to seal the abutment joint.

Such condensed gaskets can be made by several processes including one that radially compresses the gaskets to reduce their breadth, and then wraps the gaskets with a light plastic covering that holds the gaskets in a condensed state. The plastic covering can be provided with a tear strip to longitudinally rip the plastic wrap on the condensed gasket and allow it to expand after the gasket is positioned between two edge faces in an abutment joint. While this is essentially a mechanical method of keeping the gaskets in a condensed state, any process that can form a condensed gasket that can further expand to compress against both edge faces forming an abutment joint and seal that abutment joint could be used.

The compressible interior gasket and a compressible outer weather gasket can comprise any resilient material made in a compressible form that can provide adequate sealing and is also adequately durable to withstand the rigors of construction. The specific panel application may also have additional preferred requirements for the gasket material, such as thermal expansion and contraction properties within a certain range, and the ability to remain flexible over time and varying temperatures to handle building sway and movement. It is desirable the compressible outer weather gasket also preferably have adequate weathering properties, such as not being excessively affected by water and/or UV light.

Resilient materials that are believed suitable for use in the compressible interior gasket and the compressible outer weather gasket include elastomeric and rubber materials, including such things as silicone and modified silicone elastomers, ethylene propylene diene monomer (EPDM) rubbers, and other compressible crosslinked elastomers and other flexible polyurethanes and polyethylenes. The compressible forms of the gasket can include open-center and relatively hollow or hollow-lobed constructions as shown in the present figures, or varying types of closed-cell foams.

The compressible interior gasket and a compressible outer weather gasket in the dual gasket assembly are significantly compressed in the sealed abutment joint, therefore open-center, relatively hollow, or hollow-lobed gasket structures are preferred in many embodiments. Specifically, the gaskets of the dual gasket assembly preferably can durably compress such that the breadth of the dual gasket assembly in the compressed state in the sealed abutment joint is at least 80% of the original breadth, preferably at least 75% of the original breadth, and most preferably the breadth of the dual gasket assembly in the sealed abutment joint is at least 50% of the original breadth.

Figure 5:
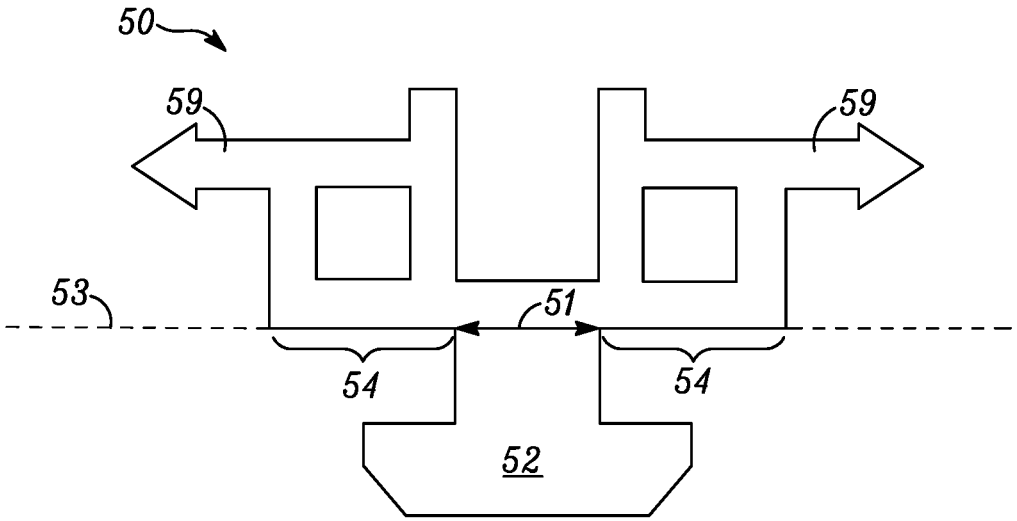
FIG. 5 is a cross-sectional view of an embodiment of the bottom surface of the base of a support coupling wherein the attachment area is at least one projection.

In many embodiments, the contact area for stabilizing the support coupling on the edge face is larger than the attachment area for attaching the support coupling to said edge face; this is particularly the case when the support coupling is attached to an edge face using an attachment area that is a projection or a cavity. FIG. 5 is a cross-sectional view of an embodiment of the bottom surface of the base of the support coupling wherein the attachment area is at least one projection. The support coupling 50 has two gaskets supports 59 having darts. As shown, support coupling 50 has a base attachment area 51 that has at least one projection 52 attaching the support coupling to the edge face 53 of a panel (the dotted line indicating the position of the edge face of the panel). The attachment area is considered the area on the bottom surface of the base, in the plane of the bottom surface on the base, that provides for the attachment of the support coupling to the edge face.

The projection 52 shown in FIG. 5 has a beveled "T" shape, designed to be slid or fitted into a C-shaped channel (or cavity) in the edge face 53 of the panel. Additionally, FIG. 5 illustrates a support coupling wherein the contact area 54 for stabilizing the support coupling on the panel edge face and the base attachment area 51 are not the same.

In some embodiments, the dual gasket assembly is suitable for sealing an abutment joint between a first surface area of a first edge face of a first panel to a second surface area of a second edge face of a second panel. On the first panel, the first surface area to be sealed is generally a rectangular area on the first edge face and has a major axis having a first surface length and a minor axis having a first surface width; and on the second panel, the second surface area to be sealed is also generally a rectangular area on the second edge face and has a major axis having a second surface length and a minor axis having a second surface width.

Figure 7:
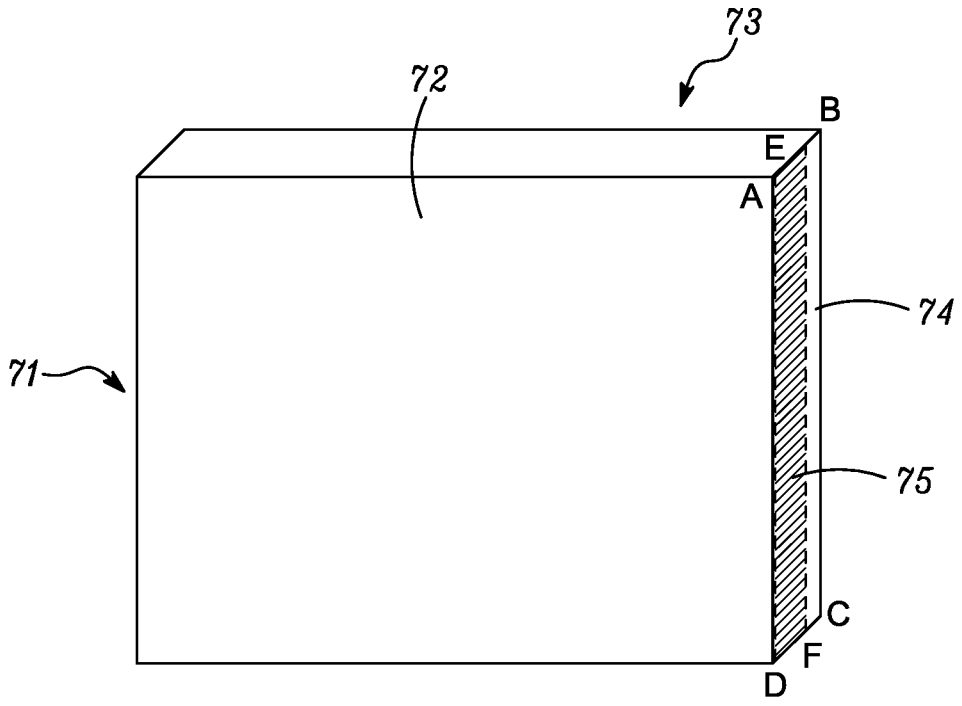
FIG. 7 is a perspective view of one representation of a panel 1 having a rectilinear shape and six sides, the six sides including two major faces and four edge faces.

FIG. 7 is a perspective view of a panel 71 having a rectilinear shape, the panel having six sides. The six sides include two major faces and four edge faces. Shown is a first major face 72 that is the frontside of the panel and an opposing second major face 73 that is the backside of the panel. When the panel is used in building construction, generally, the first major face 72 (or frontside face) is the face of the panel that is either exposed to the weather or is the face that is closest to and facing the exterior of a building; while the opposing second major face 73 (or backside face) is the face of the panel that is the interior wall of the building or is closest to and facing the interior of the building.

A dual gasket assembly is used to seal an abutment joint between a first edge face of a first panel and a second edge face of a second panel by sealing a first surface area of the first edge face of the first panel to a second surface area of the second edge face of the second panel. FIG. 7 illustrates on a first panel the first surface area to be sealed that is the shaded area on a first edge face of that panel. The first surface area has a major axis having a first surface length and a minor axis having a first surface width, the major axis being the longer dimension of the surface area on that edge face and the minor axis being the shorter dimension of the surface area on that same edge face. Likewise, but not shown, the second surface area to be sealed of the second edge face of the second panel similarly has a major axis having a second surface length and a minor axis having a second surface width, the major axis being the longer dimension of the surface area on that edge face and the minor axis being the shorter dimension of the surface area on that same edge face.

Ultimately, the gap between this first surface area of the first edge face of the first panel and the second surface area of the second edge face of the second panel is sealed via the use of a dual gasket assembly. However, for clarity, the features of the first panel will be discussed first.

Specifically, FIG. 7 illustrates a first edge face 74 of the first panel, the first edge face having a first edge face area designated by the corner points A-B-C-D. The first edge face is perpendicular to, or generally perpendicular to, both the first major face 72 and the opposing second major face 73 of the first panel, the first edge face having a first surface area 75 to be sealed, designated by the corner points A-E-F-D.

By use of the phrase "surface area to be sealed" it is meant the surface area on the edge face of a panel that will include at least partial contact with the dual gasket assembly after the gasket assembly is fully installed between the edge faces of two panels, thereby sealing the abutment gap. It is not necessary for the dual gasket assembly to be in contact with the entire width of an edge face to seal the abutment joint. In many instances, the width of the dual gasket assembly will not be as wide as the thickness of the panel, and generally it is desirable for the dual gasket assembly be placed nearer to the outer face of the panel (major face 72) and wall rather than nearer to the inner face of the panel (major face 73) and wall, sealing an area as shown by the shading in FIG. 7. In some embodiments, it will be desirable for the dual gasket assembly be placed such that that dual gasket assembly is flush with the outer face of the panel (major face 72), giving the wall an essentially continuous surface look. In some other embodiments, it will be desirable for the dual gasket assembly be placed such that that dual gasket assembly is not flush with the outer face of the panel but is recessed inwardly between the panels from the outer face of the wall; this could provide a wall surface wherein the panels and joints are much more defined, if that is the aesthetic look that is desired.

The first surface area 75 to be sealed further has a first surface length, which is represented by distance between points A-D or E-F, as the surface is generally rectangular; and a first surface width, which is represented by distance between points A-E or D-F, again as the surface is generally rectangular. Further, the surface area 75 to be sealed shown in FIG. 7 is a preferred embodiment; generally, the surface area 75 to be sealed has a first surface width A-E or D-F that is less than the width of the entire first edge face A-B or D-C, and the surface area 75 to be sealed is located closer to the frontside face (major face 72) of the panel than to the backside face (major face 73) of the panel. However, the first surface width A-E or D-F of the surface area 75 could be as wide as the first edge face 74, or the first surface width A-E or D-F could be positioned at any point within the width of the first edge face 74.

In typical rectilinear wall construction, the first major face 72 of the first panel lies in an outer plane that extends in all directions from the panel, and a plurality of the first major faces of other such panels forms an outer wall surface. Similarly, the opposing second major face 73 of the first panel lies in an inner plane that extends in all directions from the panel, and a plurality of the second major faces of other such panels forms an inner wall surface.

Although not repeated herein for conciseness, any of the features, options, and elements described herein for any of the components or steps can be applied to the processes for making a paneled wall having sealed abutment joints.

The invention claimed is:

1. A tilt wall comprising a sealed abutment joint between two concrete wall panels, the wall comprising a first wall panel, a dual gasket assembly, and a second wall panel, wherein the dual gasket assembly comprises an interior gasket, a support coupling, and a weather gasket, the first and second panels each having a height and a thickness, and each having a first major face and an opposing second major face, the first panel further having a first edge face, said first edge face being generally perpendicular to both the first major face and the opposing second major face of the first panel; the first edge face having a first edge face length that is the height of the first panel and a first edge face width that is the thickness of the first panel, the second panel further having a second edge face, said second edge face being generally perpendicular to both the first major face and opposing second major face of the second panel; the second edge face having a second edge face length that is the height of the second panel and a second edge face width that is the thickness of the second panel, wherein the first panel has metallic channel anchor forming an integral metallic channel in the first edge face, the integral metallic channel anchor being oriented such that the metallic channel in the first edge face is parallel to the first edge face length; and wherein the support coupling for the dual gasket assembly is attached to the panel by the metallic channel, the support coupling comprising a base, the base having a top surface and a bottom surface, the top surface further having an interior gasket support and an exterior gasket support, the bottom surface of the base having a contact area for stabilizing the support coupling on the edge face, the bottom surface further having an attachment area for attaching the support coupling to said metallic channel, the attachment area being at least one projection;

wherein the first and second wall panels as aligned adjacent to one another, such that the first major face of the first wall panel and the first major face of the second wall panel lie in the same first plane, and the opposing second major face of the first wall panel and the opposing second major face of the second wall panel lie in the same second plane, and the first and second planes form a set of parallel major face planes, and the first edge face of the first wall panel and the second edge face of the second wall panel also form a set of parallel edge face planes, with the support coupling of the dual gasket assembly attached to the first edge face and positioned between the first edge face of the first wall panel and the second edge face of the second wall panel, within both the set of parallel major face planes and the set of parallel edge face planes, the second edge face of the second wall panel positioned relative to the first wall panel a desired distance proximate the first edge face to form a desired breadth of the abutment joint between the edge faces;

the interior gasket is attached to the interior gasket support and the outer weather gasket is attached to the exterior gasket support, the interior gasket and the outer weather gasket in contact with and compressed against both the first edge face of the first panel and the second edge face of the second panel to seal the abutment joint between the said edge faces of the two panels.

2. A tilt wall panel comprising a first wall panel and a dual gasket assembly suitable for use in a wall having a sealed abutment joint between two concrete wall panels, wherein the dual gasket assembly comprises an interior gasket, a support coupling, and a weather gasket, the first wall panel each having a height and a thickness, and having a first major face and an opposing second major face, wherein the first major face of the first wall panel lies in a first plane, and the opposing second major face of the first wall panel lies in a second plane, and the first and second planes form a set of parallel major face planes, the first wall panel further having a first edge face, said first edge face being generally perpendicular to both the first major face and the opposing second major face of the panel; the first edge face having a first edge face length that is the height of the first wall panel and a first edge face width that is the thickness of the first wall panel, wherein the first wall panel has metallic channel anchor forming an integral metallic channel in the first edge face, the integral metallic channel anchor being oriented such that the metallic channel in the first edge face is parallel to the first edge face length; and wherein the support coupling for the dual gasket assembly is attached to the first wall panel by the metallic channel, the support coupling comprising a base, the base having a top surface and a bottom surface, the top surface further having an interior gasket support and an exterior gasket support, the bottom surface of the base having a contact area for stabilizing the support coupling on the first edge face, the bottom surface further having an attachment area for attaching the support coupling to said metallic channel, the attachment area being at least one projection;

with the support coupling of the dual gasket assembly attached to the first edge face within both the set of parallel major face planes, and the interior gasket is attached to the interior gasket support and the outer weather gasket is attached to the exterior gasket support.

* * * * *